US010808917B2

(12) United States Patent
Harris et al.

(10) Patent No.: US 10,808,917 B2
(45) Date of Patent: Oct. 20, 2020

(54) ENCLOSURE FOR A LUMINAIRE

(71) Applicant: Hubbell Incorporated, Shelton, CT (US)

(72) Inventors: Joseph Harris, Anderson, SC (US); Anthony Sinphay, Greenville, SC (US); Marty Knox, Spartanburg, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/374,339

(22) Filed: Apr. 3, 2019

(65) Prior Publication Data

US 2019/0301710 A1 Oct. 3, 2019

Related U.S. Application Data

(60) Provisional application No. 62/652,058, filed on Apr. 3, 2018.

(51) Int. Cl.
*F21V 15/01* (2006.01)
*F21V 21/04* (2006.01)

(52) U.S. Cl.
CPC ..... *F21V 15/01* (2013.01); *F21V 21/04* (2013.01)

(58) Field of Classification Search
CPC ..... F21V 15/01; F21V 21/04
See application file for complete search history.

(56) References Cited

U.S. PATENT DOCUMENTS

| | | | | |
|---|---|---|---|---|
| 6,779,910 | B1 * | 8/2004 | Pelton | F21S 8/02 362/260 |
| 9,068,722 | B2 * | 6/2015 | Wronski | F21V 17/02 |
| 2016/0320044 | A1 * | 11/2016 | Romano | F21V 15/01 |
| 2017/0102116 | A1 * | 4/2017 | Sherry | F21V 31/00 |
| 2019/0086043 | A1 * | 3/2019 | Wronski | F21S 8/026 |
| 2019/0319462 | A1 * | 10/2019 | Hsu | F21S 9/02 |

* cited by examiner

*Primary Examiner* — Donald L Raleigh
(74) *Attorney, Agent, or Firm* — Michael Best & Friedrich, LLP

(57) ABSTRACT

An enclosure for a luminaire includes a plastic elongated main body that extents along an axis between a first end and a second end. A first compartment is disposed proximate the first end and a second compartment is disposed proximate the second end. A wall extends orthogonal to the axis and partitions the first compartment from the second compartment. The wall includes an aperture that provides communication between the first compartment and the second compartment.

19 Claims, 10 Drawing Sheets

ENCLOSURE FOR A LUMINAIRE

CROSS-REFERENCE TO RELATED APPLICATION

This application claims the benefit of prior-filed, U.S. Provisional Patent Application No. 62/652,058, filed Apr. 3, 2018, the entire contents of which are hereby incorporated by reference.

BACKGROUND

The present disclosure relates to a luminaire, and more specifically, to an enclosure for a luminaire.

SUMMARY

In one embodiment, an enclosure for a luminaire includes a plastic elongated main body that extents along an axis between a first end and a second end. A first compartment is disposed proximate the first end and a second compartment is disposed proximate the second end. A wall extends orthogonal to the axis and partitions the first compartment from the second compartment. The wall includes an aperture that provides communication between the first compartment and the second compartment.

In another embodiment, an enclosure for a luminaire includes a main body made from plastic and has a first end and a second end defining an area larger than the first end. A body axis extends between the first end and the second end. A stepped surface is disposed between the first end and the second end. The stepped surface is orthogonal with respect to the body axis. An opening is disposed at the second end. A cavity is disposed within the main body and is configured to receive a light emitter.

In another embodiment, an enclosure for a luminaire includes a plastic elongated main body that extends along an axis between a first end and a second end. A first compartment is disposed within the main body proximate the first end and a second compartment is disposed within the second compartment proximate the second end. A wall extends orthogonal to the axis and partitions the first compartment from the second compartment. The wall includes an aperture that provides communication between the first compartment and the second compartment. A light emitter is disposed within the second compartment.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to an enclosure for housing a luminaire including a light emitting device, such as a light emitting diode (LED). The enclosure is made from plastic. In some embodiments, the enclosure can be retrofitted with trims of recessed downlight luminaires.

Figure 1:
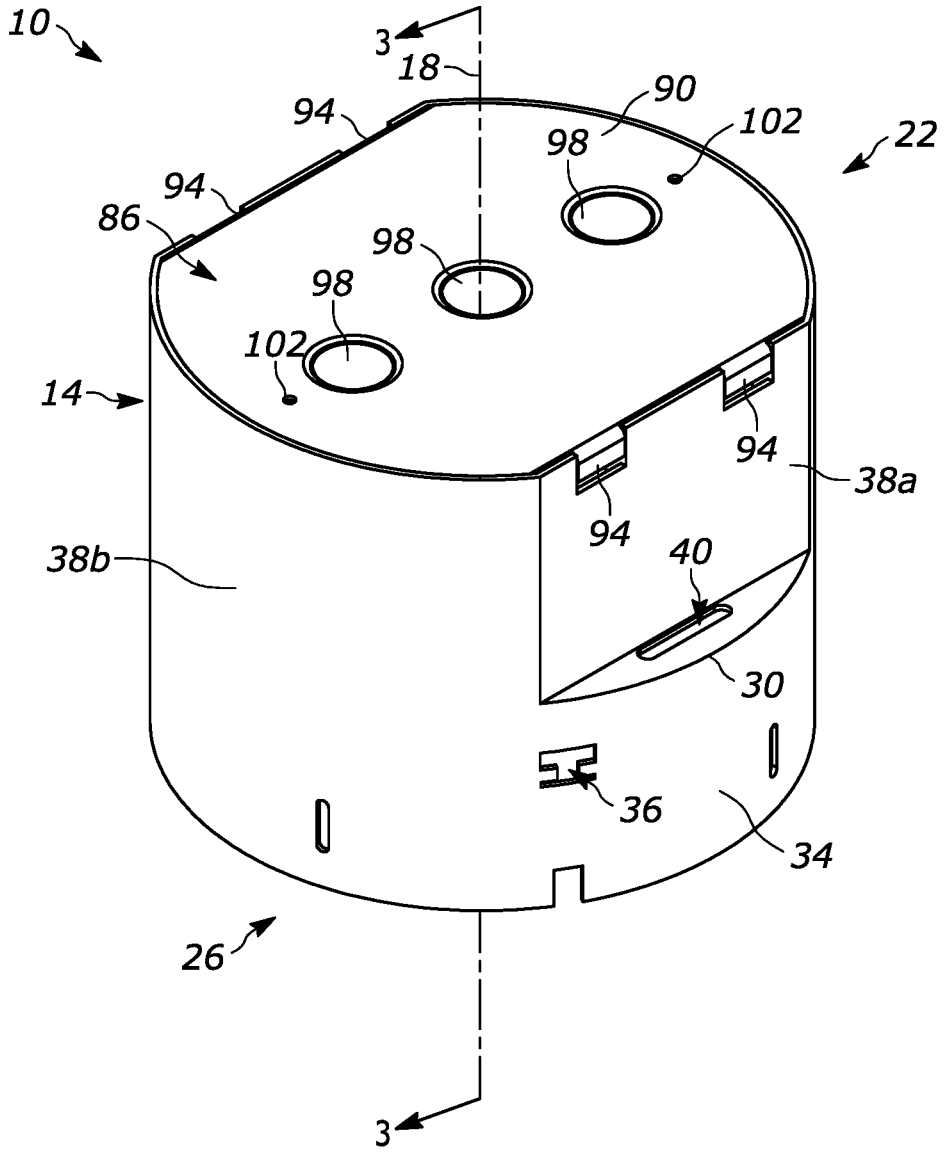
FIG. 1 is a perspective view of an enclosure for a luminaire.

FIG. 1 illustrates an enclosure 10 for a recessed luminaire 106 that houses a light emitting device (not shown). The enclosure 10 includes an elongated main body 14 that extends along a body axis 18. The main body 10 includes a first end 22 and a second end 26, and the body axis 18 extends therebetween. In the illustrated embodiment, an outer surface of the main body 14 is generally cylindrical in shape, although in some embodiments, the outer surface may be tapered from the second end 26 to the first end 22.

Figure 3:
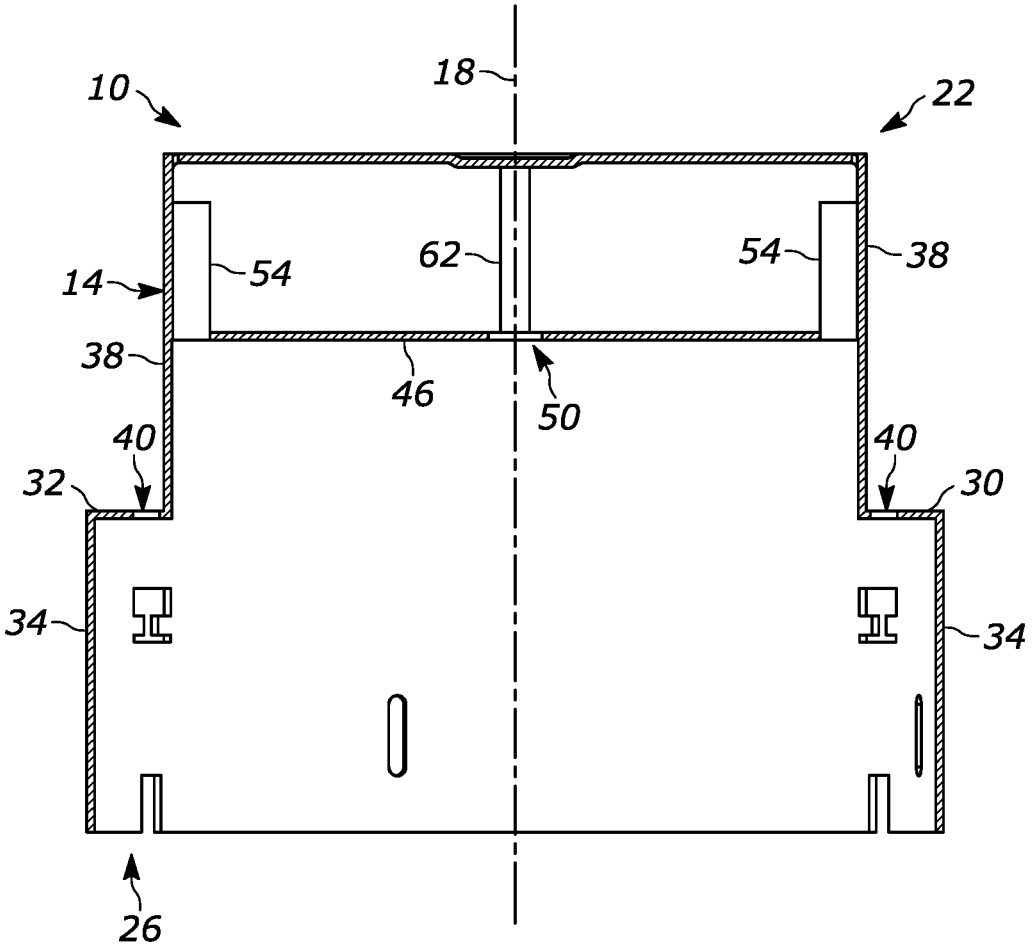
FIG. 3 is a cross-sectional view of the enclosure for the luminaire of FIG. 1, viewed along section 3-3.

In the illustrated embodiment, the main body 14 includes a first stepped surface 30 and a second stepped surface 32 (FIG. 3). The stepped surfaces 30, 32 are positioned on opposite sides of the body axis between the first end 22 and the second end 26. The stepped surfaces 30, 32 are also oriented in a plane that is substantially orthogonal to the body axis 18. A first portion 34 of the outer surface between the second end 26 and the stepped surfaces 30, 32 has a substantially cylindrical profile; in other embodiments, the first portion 34 may define another type of profile, including other types of curvilinear profiles (e.g., circular, frustoconical, elliptical). In the illustrated embodiment, the first portion 34 includes slots or apertures 36. Second portions 38A of the outer surface, disposed between the first end 22 and each stepped surface 30, 32, includes a planar surface 38 extending parallel to the body axis 18 and symmetric about the body axis 18. Third portions 38B of the outer surface that are disposed angularly between second portions 38A can have profile (e.g., circular, frustoconical, elliptical) that follows the profile of the first portion 34. The distance from a center of the main body 14 to either planar surface 38A is less than the radius of the first or third portions 34, 38B of the main body 14. In the illustrated embodiment, the radius of the first portion 34 is equal to the radius of the third portion 38B. Also, an elongated slot 40 is positioned on each of the stepped surfaces 30 proximate the respective planar surface 38A and extends at least partially along the stepped surface 30 in a direction transverse to the body axis 18.

Figure 2:
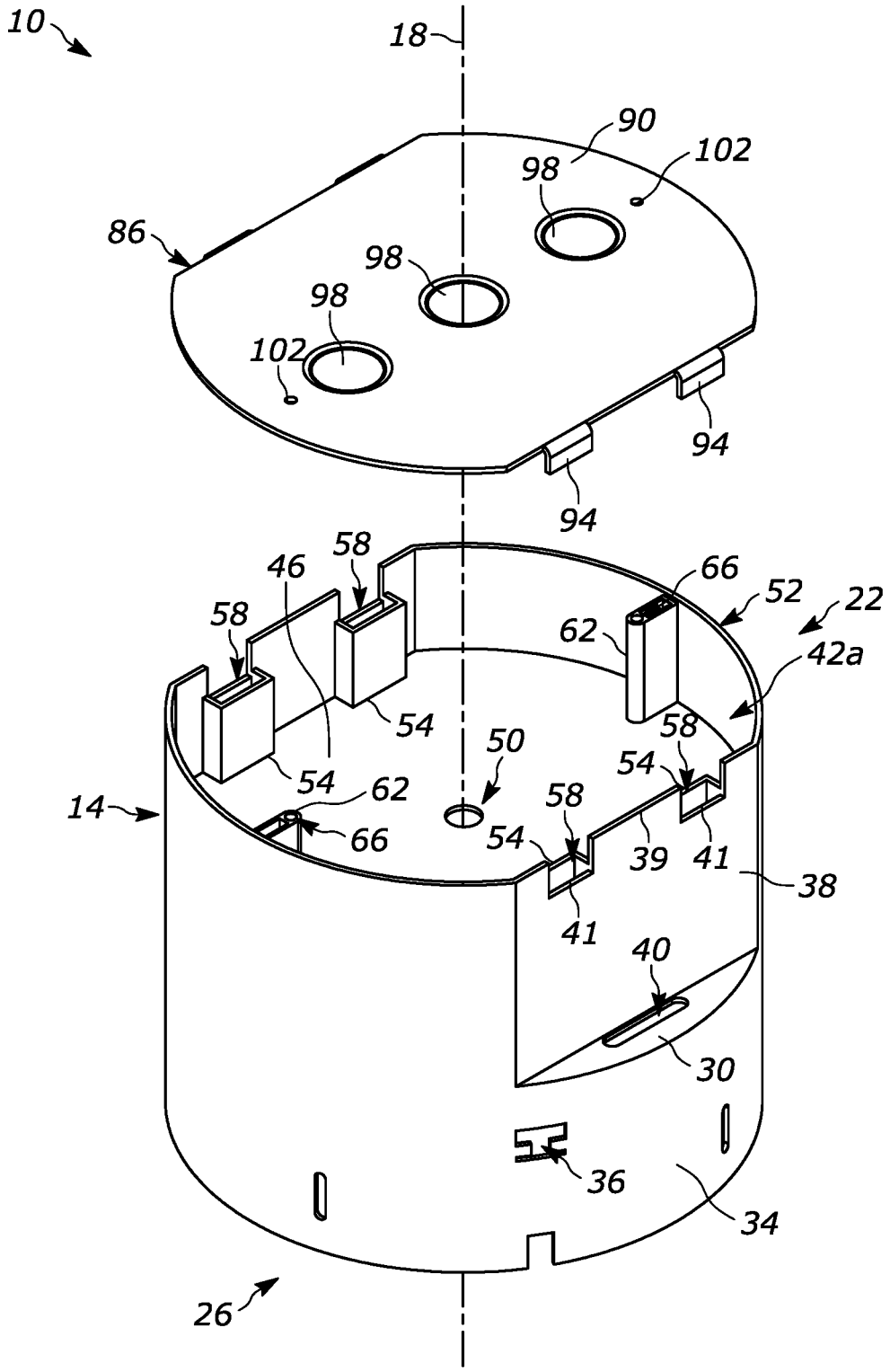
FIG. 2 is an exploded view of the enclosure for the luminaire of FIG. 1.
Figure 5:
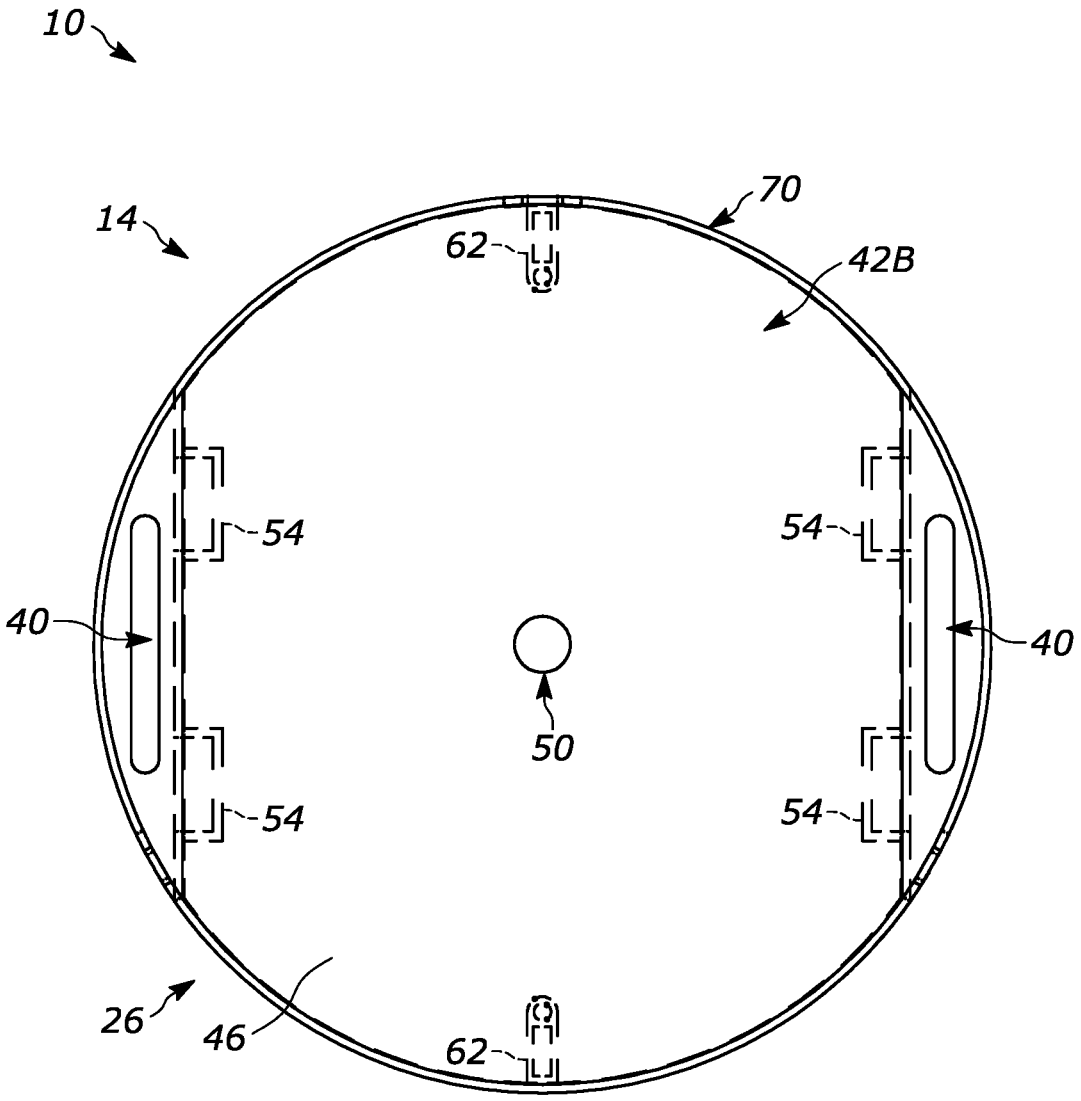
FIG. 5 is a bottom view of the enclosure for the luminaire of FIG. 1.

As shown in FIGS. 2 and 3, the main body 14 is substantially hollow. In the illustrated embodiment, a partition wall 46 extends in a direction transverse to the body axis 18 (e.g., parallel to the stepped surfaces 30, 32), thereby partitioning an internal space of the main body 14 into a first compartment 42A and a second compartment 42B (FIG. 5). In the illustrated embodiment, the partition wall 46 is positioned closer to the first end 22 than the second end 26 (FIG. 3). Thus, a volume of the second compartment 42B is greater than a volume of the first compartment 42A. The partition wall 46 also includes an aperture 50. In the illustrated embodiment, the aperture 50 is aligned with the body axis 18 and provides communication between the first compartment 42A and the second compartment 42B; although in other embodiments, the aperture 50 may not be aligned with the body axis 18.

As shown in FIG. 2, the first compartment 42A includes cutout portions with first or upper edges 39 and second or lower edges 41. The upper edges 39 define at least a portion of the top of the first compartment 42A. The lower edges 41 are spaced apart from the partition wall 46. In the illustrated embodiment, the planar surfaces 38 include the upper and lower edges 39, 41.

Figure 4:
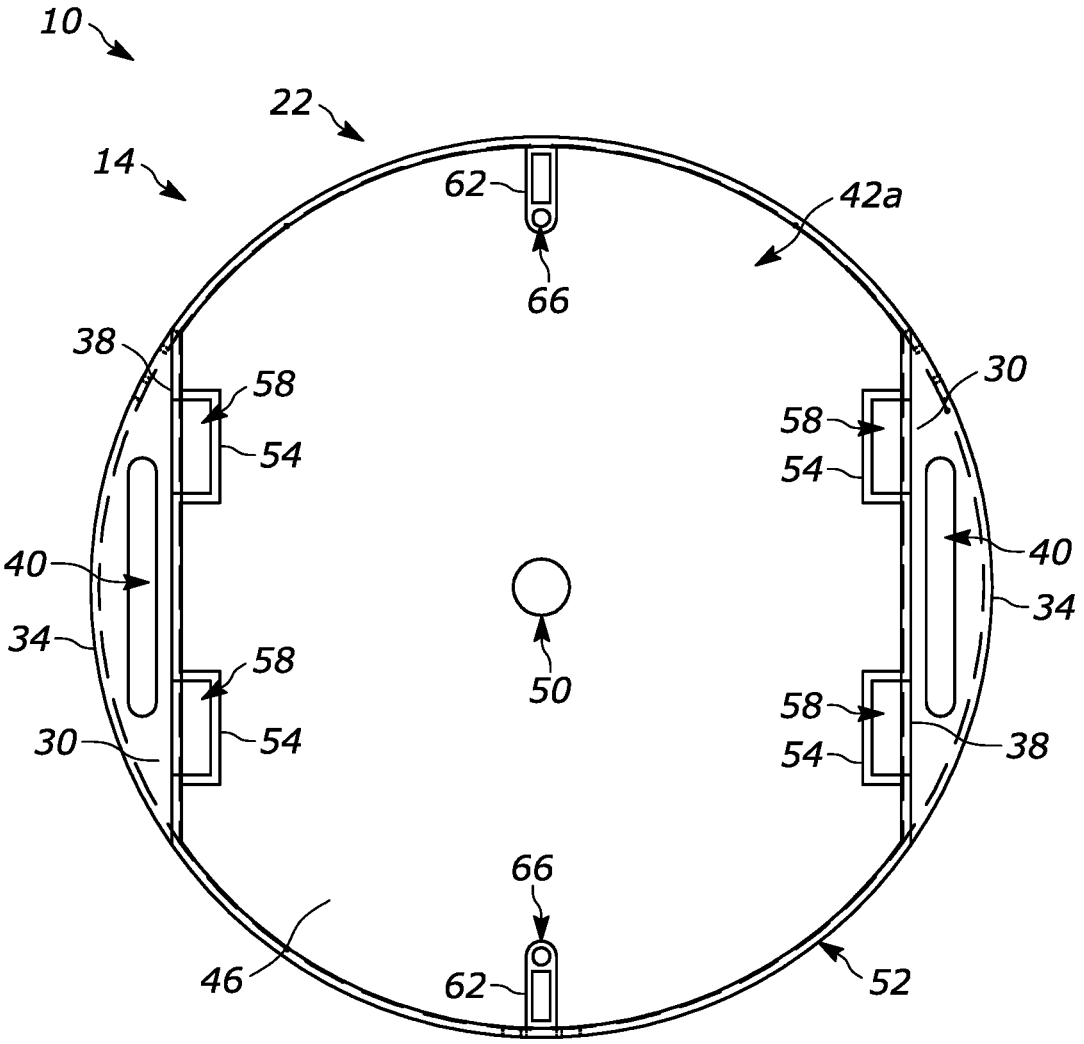
FIG. 4 is a top view of the enclosure for the luminaire of FIG. 1.

As shown in FIGS. 2 and 4, the first end 22 of the main body 14 includes a first opening 52 to the first compartment 42A. The first compartment 42A includes securing devices 54. In the illustrated embodiment, the main body 14 includes four securing devices 54 that are substantially rectangular in shape. Two of the securing devices 54 are positioned adjacent each of the planar surfaces 38. Each securing device 54 includes an aperture 58 that extends in a direction parallel to the body axis 18. A top of each aperture 58 is positioned adjacent to one of the lower edges 41. The first compartment 42A also includes projections 62. In the illustrated embodiment, the main body 14 includes two projections 62, each positioned adjacent an outer edge of the compartment 42A and extending toward the aperture 50. The projections 62 can be positioned on opposite sides of the body axis 18 from one another. Each projection 62 also includes an opening 66 that extends in a direction parallel to the body axis 18.

As shown in FIG. 5, the second end 26 of the main body 14 includes a second opening 70 to the second compartment 42B. The second compartment 42B is defined between the planar surfaces 38. In the illustrated embodiment, there are no features are disposed within the second compartment 42B. In other words, there are no projections along the length of the second compartment 42B between the second opening 70 and the partition wall 46.

Returning to FIGS. 1 and 2, the enclosure 10 includes a cover 86 with a plate 90 that is substantially the same shape as the first opening 52. Tabs 94 extend from a straight edge of the plate 90 and may be formed at a right angle with respect to the plate 90. In the illustrated embodiment, two tabs 94 extend from each straight edge of the plate 90. Each tab 94 is substantially the same length and extends in the same direction.

Removable or knockout sections 98 are formed on the plate 90. In the illustrated embodiment, the plate 90 includes three knockout sections 98 spaced apart and aligned along an axis parallel to the straight edges of the plate 90. The knockout sections 98 are circular in shape and have similar sizes with respect to one another. Each knockout section 98 may be independently removed from the plate 90 to create an aperture (not shown) which extends through a thickness of the body.

The cover 86 is removably coupled to the main body 14. The plate 90 is positioned proximate the first opening 52 so that the tabs 94 are positioned proximate the cut out portions (i.e., the upper and lower edges 39, 41) of the planar surfaces 38. The tabs 94 on the cover 86 are positioned adjacent the lower edges 41 so that the cover 86 encloses the first compartment 42A (FIG. 1). A hole 102 is positioned proximate opposite ends (e.g., curved edges that extend angularly between the straight edges) of the plate 90. Each hole 102 is aligned with a respective opening 66. A fastening member (e.g., a threaded screw—not shown) may be received within each set of holes 102 and openings 66 to further couple the cover 86 to the main body 14. Holes (not shown) formed from the removal of knockout sections 98 provide communication between the external environment and the first compartment 42A while the cover 86 is coupled to the main body 14.

In some embodiments, springs or hangers (not shown) can be positioned in the slots 40 and/or the apertures 36. Springs may be positioned in the slots 40 to retain the enclosure 10 within a recess in a ceiling (not shown). Additionally, plaster frames or hanger bars may be coupled to the apertures 36 and used as another method to retain the enclosure 10 in the ceiling.

Figure 6:
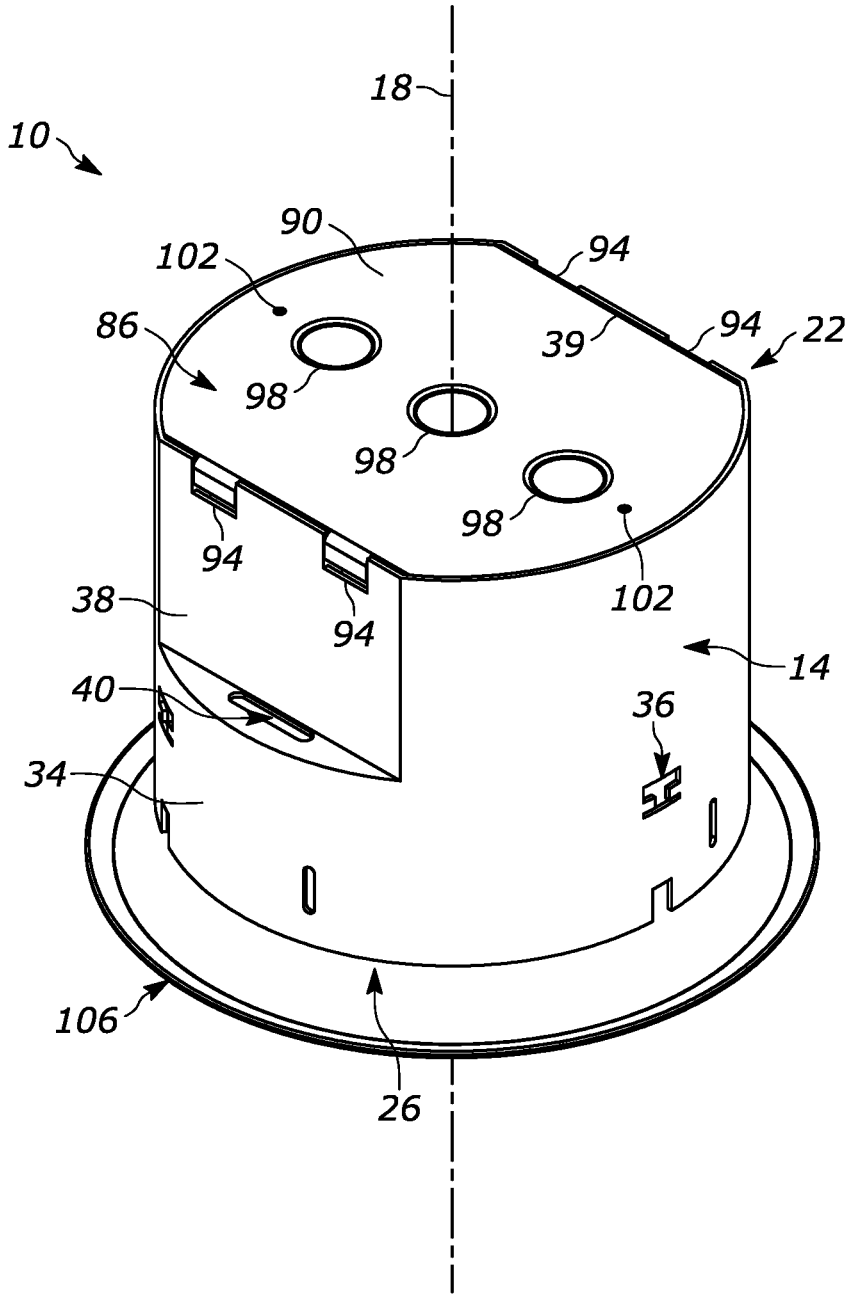
FIG. 6 is a perspective view of enclosure of FIG. 1 coupled to a trim.
Figure 7:
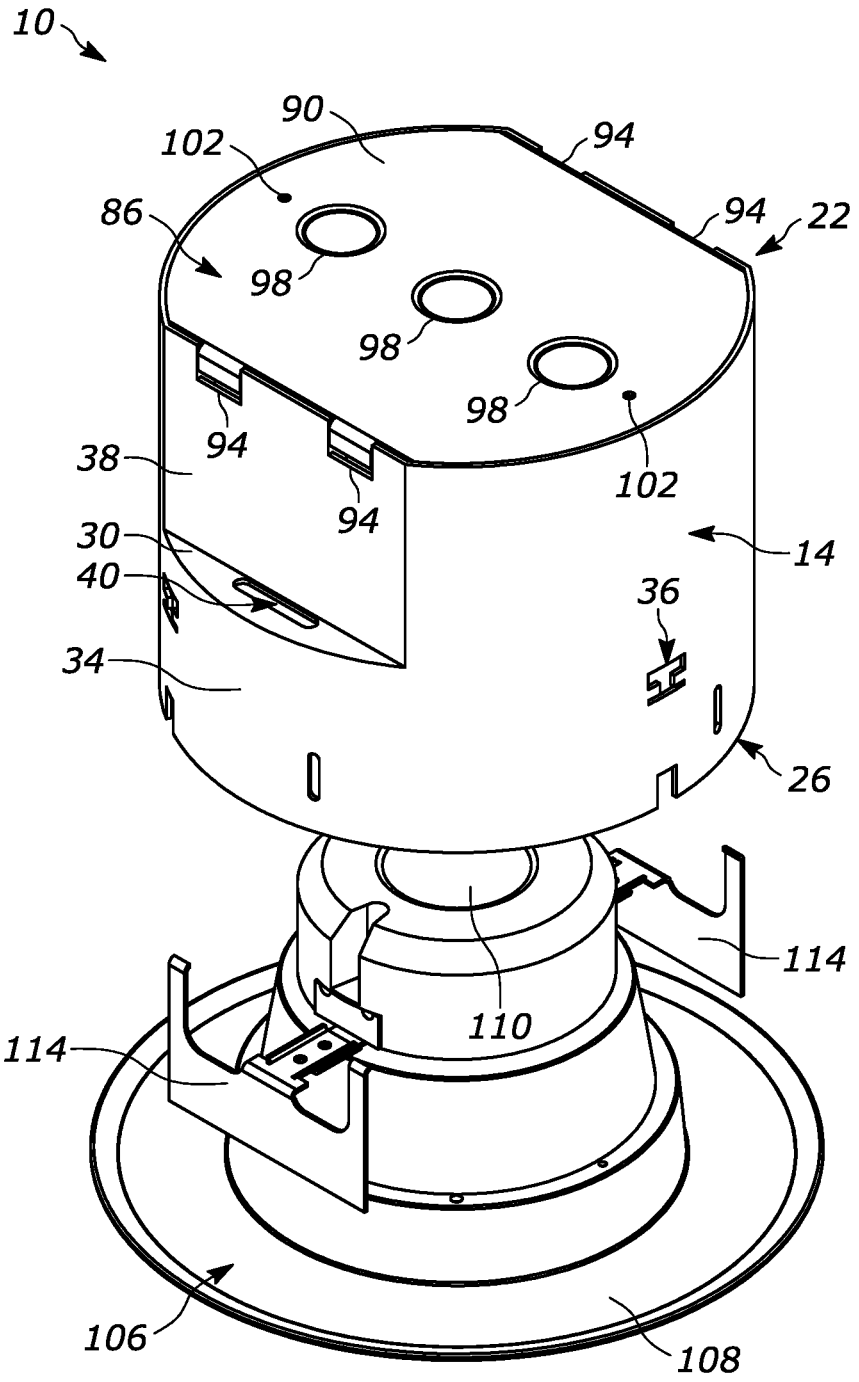
FIG. 7 is an exploded view of the enclosure of FIG. 6.

As shown in FIGS. 6 and 7, the enclosure 10 is configured to house a luminaire (e.g., a recessed luminaire) 106 having light emitting device(s) and its associated driver(s) (neither shown). The light emitting device(s) are configured to be positioned within the second compartment 42B and the driver(s) are configured to be positioned within the first compartment 42A. Wires (not shown) electrically connecting the driver(s) and the light emitting device(s) pass through the aperture 50. Additional wires (not shown) also pass through the apertures 58 of the securing devices 54. These wires may specifically be Romex wires, and the securing devices 54 provide strain relief for the Romex wires and prevent the wires from pulling out of the apertures 58. Additionally, electrical conductor(s) (not shown) may extend from the drivers to an electrical outlet (e.g., a wall outlet—not shown) in order to provide the light emitting device(s) with electrical power. A user may remove one or more of the knockout sections 98 in order to create a hole to allow the electrical conductor(s) to extend out of the first compartment 42A while the cover 86 is coupled to the main body 14 (FIG. 1).

A trim 109 of the luminaire 106 is retrofitted with the enclosure 10. In some embodiments, the luminaire 106 includes light emitting device(s) (e.g., LEDs) and driver(s) disposed in a driver section 110. The trim of the luminaire 106 is received within the second compartment 42B so that both the light emitting device(s) and the driver(s) are disposed in the second compartment 42B. In the illustrated embodiment, the trim 109 of the luminaire 106 includes mounting portions 114, which are received within the second compartment 42B proximate the planar surfaces 38. Wires (not shown) pass through the apertures 50, 58 in order to electrically connect the driver(s) to an electrical outlet and provide electrical current to the light emitting devices.

In the illustrated embodiment, the light emitting devices are light emitting diodes (LEDs) and the enclosure 10 is made from plastic. Unlike traditional light emitters (e.g., incandescent light bulbs) that emit a substantial amount of heat and are housed in enclosures made from materials with higher temperature resistances or melting points (e.g., steel or other metals), the enclosure 10 is made from plastic, which is less expensive and easier to manufacture.

The enclosure 10 is configured to retrofit with down recessed luminaires and other lamps 106. Thus, unnecessary and expensive steel enclosures (not shown) may be replaced with less expensive plastic enclosures 10 to house LEDs in the luminaires 106.

The enclosure 10 may be formed to facilitate stacking or nesting with other enclosures (not shown). For example, the outer surface of the enclosure 10 includes stepped surfaces 30, 32, or may be tapered. A second opening of a second enclosure (not shown) can receive the first end 22 of the enclosure 10 so that a second end of the second enclosure abuts the stepped surfaces 30, 32 of the enclosure 10. Alternatively or in addition, the second opening 70 of the enclosure 10 can receive a first end of a third enclosure so that the second end 26 of the enclosure 10 abuts stepped surfaces of the third enclosure. Any number of enclosures may be stacked together in the manner described above, thereby permitting easier storage of the enclosures for inventory purposes.

Figure 8:
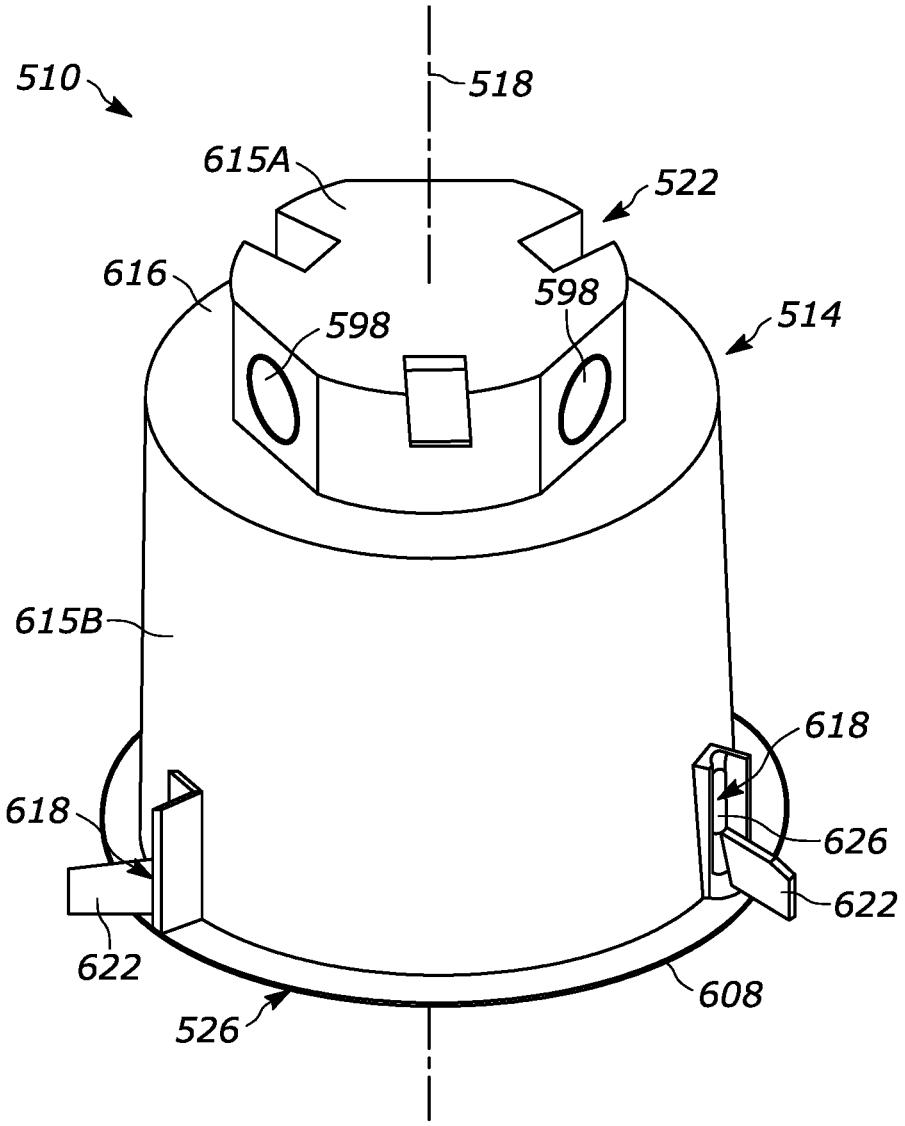
FIG. 8 is a perspective view of an enclosure according to another embodiment.
Figure 9:
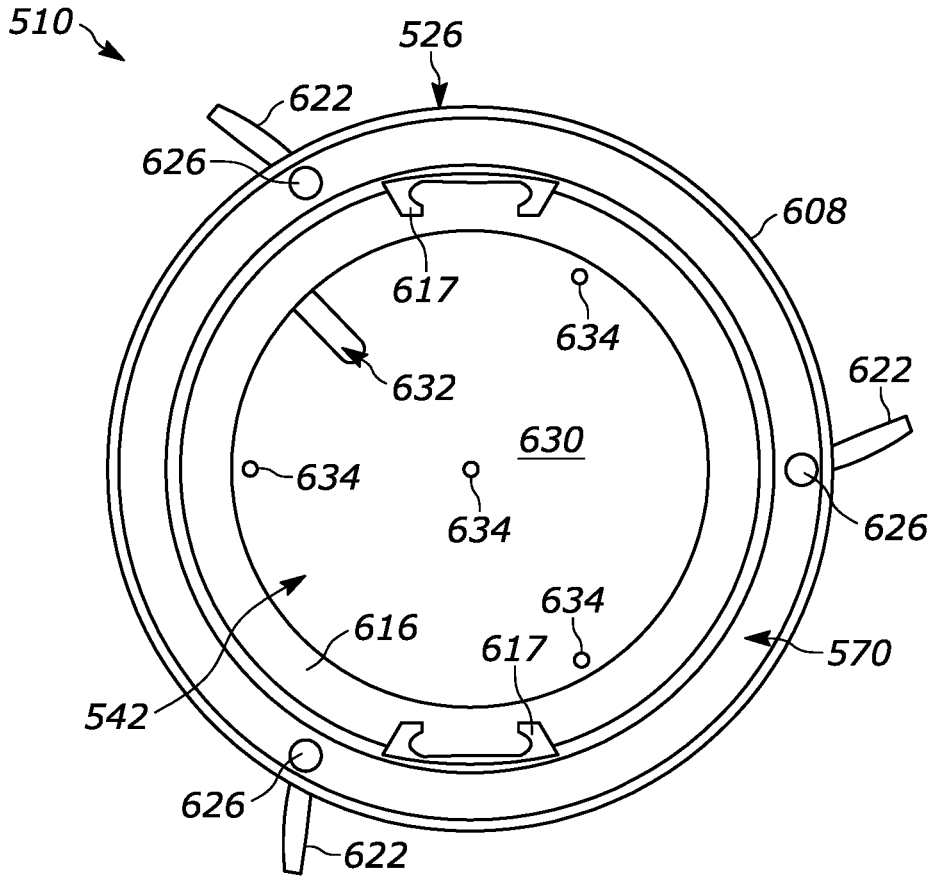
FIG. 9 is a bottom view of the enclosure for the luminaire of FIG. 8.
Figure 10:
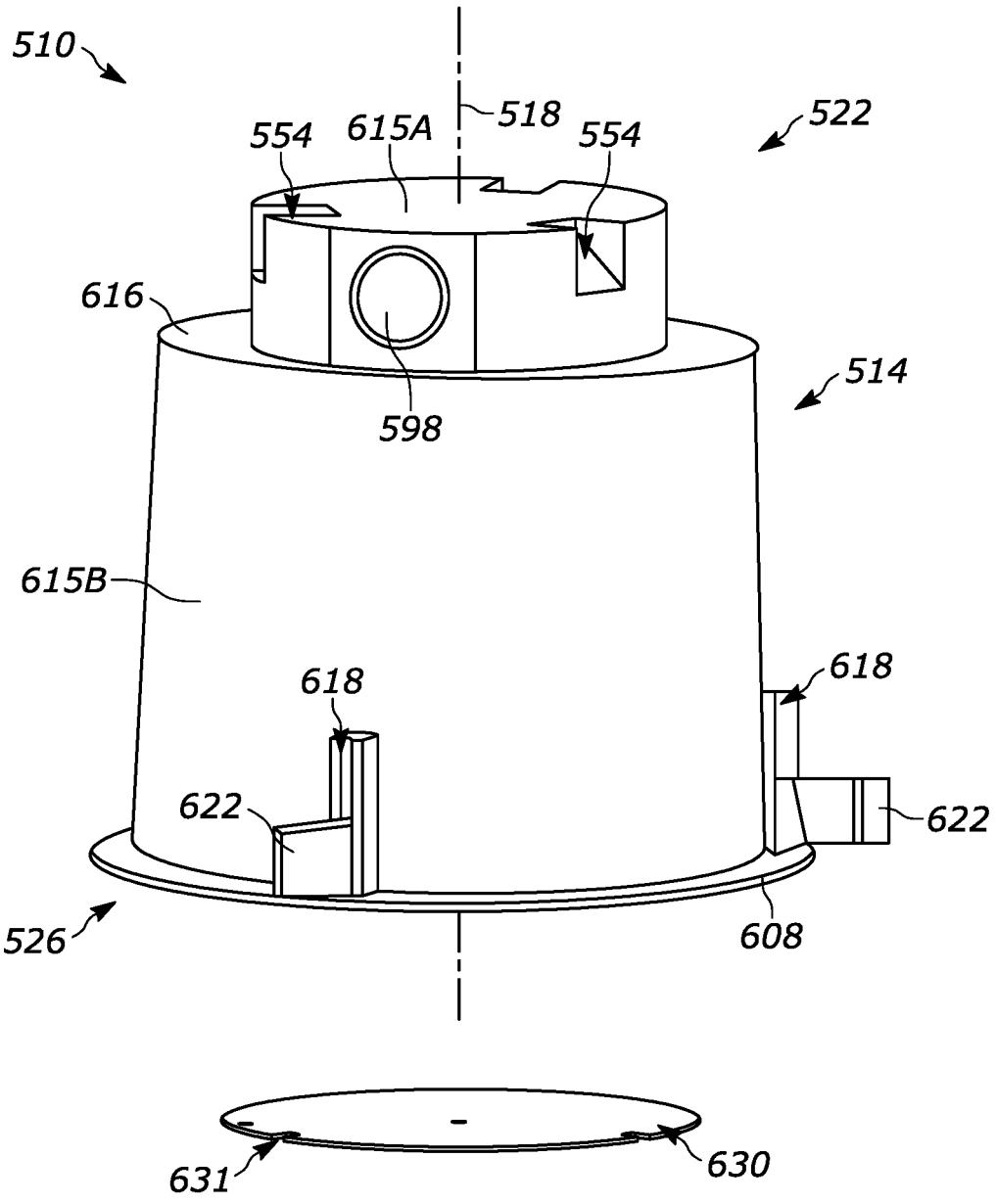
FIG. 10 is an exploded view of the enclosure for the luminaire of FIG. 8.

FIGS. 8-10 illustrate an enclosure 510 according to another embodiment. At least some differences and/or similarities between the enclosure 10 and enclosure 510 are described below. Similar features are identified by similar reference numbers, plus 500.

As shown in FIG. 8, the enclosure 510 includes an elongated main body 514 that extends along a body axis 518. The main body 514 includes a first end 522 and a second end 526, and the body axis 518 extends therebetween. In the illustrated embodiment, the enclosure 510 includes slots 618 proximate the second end 526. In the illustrated embodiment, the main body 514 is slightly tapered from the second end 526 to the first end 522 so that the outer surface is not perfectly cylindrical. A lip 608 is positioned proximate the second end 526 and is the widest portion of the main body 514. Retention tabs 622 are received within the slots 618 and extend away from the outer surface of the main body 514. Fasteners 626 (e.g., threaded screws (FIG. 9)) can secure the retention tabs 622 within the slots 618. In the illustrated embodiment, the main body 514 is tapered.

A first or upper housing 615A is integrally formed on and extends from an upper surface (e.g., a stepped surface) 616 of a second or lower housing 615B. The surface 616 is disposed between the first end 522 and the second end 526. The surface 616 is also orthogonal to a respective axis parallel to the body axis 518. A radius of the upper housing 606 is less than a radius of the surface 616. The upper housing 615A includes removable or knockout sections 598. In the illustrated embodiment, the knockout sections 598 are circular and have similar sizes. Each knockout section 598 may be independently removed from the upper housing 615A to create an aperture (not shown) which extends through a wall of the upper housing 615A. In the illustrated embodiment, the upper housing 615A includes three knockout sections 598 spaced apart and around the axis 518. The knockout sections 598 are disposed on surfaces of the upper housing 615A and are oriented parallel to the axis 518. The upper housing 615A also includes securing devices 554 that provide strain relief for the Romex wires and prevent the wires from pulling out of the securing devices 554.

As shown in FIG. 9, the main body 514 is hollow and includes an internal cavity 542. The cavity 542 extends through the main body 514 from the first end 522 to the second end 526. The second end 526 of the main body 514 includes an opening 570 to the internal cavity 542. The internal cavity 542 includes projections 617 that extend from a surface opposite the outer surface toward the center of the main body 514. In the illustrated embodiment, the projections 617 have a general U-shape space that is narrower proximate the center of the main body 514.

As shown in FIGS. 8 and 9, grounding plate 630 has a generally circular body and is positioned within the cavity 542. In the illustrated embodiment, the grounding plate 630 is made from steel and is positioned adjacent the upper housing 615A in order to partition the upper housing 615A from the remainder of the cavity 542. The grounding plate 630 includes apertures 634 disposed throughout the body. The apertures 634 may receive fasteners (e.g., threaded screws—not shown) to couple the grounding plate to an inner surface of the cavity 542. The grounding plate 630 includes a slit 631 (FIG. 10) that is positioned around a slot 632 of the enclosure 510. The slot 632 provides communication between the upper housing 615A and the remainder of the cavity 542 while the grounding plate 630 is positioned within the cavity 542.

The enclosure 510 is configured to house one or more light emitting device(s) and associated drivers (not shown). The light emitting device(s) and drivers are configured to be positioned within the cavity 542 proximate the grounding plate 630. Wires (not shown) electrically connect the drivers and the light emitting devices. Additionally, electrical conductor(s) (not shown) may extend from the drivers, through the slot 632, and to an electrical outlet (e.g., a wall outlet—not shown) in order to provide the light emitting device(s) with electrical power. A user may remove one or more of the knockout sections 598 in order to create a hole to allow the electrical conductor(s) to extend out of the cavity 542.

Like the enclosure 10, the enclosure 510 is configured to be made from plastic and house an LED. The enclosure 510 can be retrofitted into existing downlight recessed luminaires and other lamps 615A, permitting more expensive enclosures to be replaced with less expensive ones.

The taper facilitates stacking or nesting the enclosure 510 with other enclosures. An opening of a second enclosure (not shown) can receive the first end 522 of the enclosure 510 so that the upper housing 606 is positioned within the second enclosure. Alternatively or in addition, the opening 570 of the enclosure 510 can receive a first end of a third enclosure so that an upper housing of the third enclosure is positioned within the enclosure 510. Any number of enclosures may be stacked together in the manner described above.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. An enclosure for a luminaire, comprising:

a plastic elongated and integrally-formed main body extending along an axis between a first end and a second end, the main body configured to be recessed relative to a support structure;

a first compartment disposed within the main body proximate the first end and a second compartment disposed within the main body proximate the second end; and a wall extending orthogonal to the axis and partitioning the first compartment from the second compartment, the wall including an aperture providing communication between the first compartment and the second compartment.

2. The enclosure for a luminaire of claim 1, further comprising a trim with a light engine and the light emitter, the trim receivable within the second compartment.

3. The enclosure for a luminaire of claim 1, further comprising a cover removably couplable to the main body proximate the first compartment, wherein the cover includes at least one knockout configured to provide communication between the first compartment and an external environment while the cover is coupled to the main body.

4. The enclosure for a luminaire of claim 1, wherein the partition wall is positioned proximate the first end such that the second compartment has a greater volume than the first compartment.

5. The enclosure for a luminaire of claim 1, wherein the main body further includes a stepped outer surface such that an opening at the second end has a greater area than an opening at the first end, the stepped surface configured to stack with a second enclosure, the stepped surface including an elongated slot configured to receive a biasing member.

6. The enclosure for a luminaire of claim 1, wherein the main body includes a first stepped surface disposed between the first end and the second end;

a second stepped surface disposed between the first end and the second end, the second stepped surface disposed symmetric to the first stepped surface about the axis;

a first portion disposed between the first end and the stepped surface, the first portion having a curvilinear profile and extending around the perimeter of the main body;

second portions disposed between each respective stepped surface and the second end, the second portions having a planar profile and extending around a portion of the perimeter of the main body;

third portions disposed between each respective stepped surface and the second end, the third portions having curvilinear profile and extending around a portion of the perimeter of the main body angularly between each of the second portions, the third portions and the first portion having substantially the same radius.

7. The enclosure for a luminaire of claim 1, wherein the first compartment further includes a securing device providing communication between the first compartment and the second compartment, the securing device configured to provide strain relief for a Romex wire received within the securing device.

8. An enclosure for a luminaire, comprising:

a main body made from plastic and configured to be recessed relative to a support structure, the main body including a first end and a second end defining an area larger than the first end, a body axis extending between the first end and the second end, and a stepped surface between the first end and the second end, the stepped surface orthogonal with respect to the body axis;

an opening disposed at the second end;

a cavity disposed within the main body and configured to receive a light emitter;

a wall partitioning the cavity positioned proximate the first end such that a second compartment of the cavity has a greater volume than a first compartment of the cavity.

9. The enclosure for a luminaire of claim 8, wherein the wall includes an aperture providing communication between the first compartment and the second compartment.

10. The enclosure for a luminaire of claim 8, further comprising a trim with a light engine and the light emitter, the trim receivable within the cavity.

11. The enclosure for a luminaire of claim 8, wherein the main body has a generally cylindrical shape and tapers from the second end toward the first end, the cavity extends continuously between the first end and the second end, a first housing is disposed proximate the first end and a second housing is disposed proximate the second end with a width and volume substantially larger than the first housing, at least one of a knockout and a securement device positioned on the first housing and configured to provide communication between an external environment and the cavity.

12. The enclosure for a luminaire of claim 8, wherein the main body has a lesser diameter proximate the first end than proximate the second end, the main body configured to stack with a main body of a second enclosure.

13. The enclosure for a luminaire of claim 8, further comprising a cover removably couplable to the main body proximate the first compartment, wherein the cover includes at least one knockout configured to provide communication between the first compartment and an external environment while the cover is coupled to the main body.

14. The enclosure for a luminaire of claim 8, wherein a grounding plate is positionable within the cavity.

15. An enclosure for a luminaire, comprising:

a plastic elongated main body extending along an axis between a first end and a second end;

a first compartment disposed within the main body proximate the first end and a second compartment disposed within the main body proximate the second end;

a wall orthogonal to the axis and partitioning the first compartment from the second compartment; and a light emitter disposed within one of the first compartment and the second compartment, the light emitter including a mounting portion coupled to the plastic elongated main body.

16. The enclosure for a luminaire of claim 15, further comprising a cover removably couplable to the main body proximate the first compartment, wherein the cover includes at least one knockout configured to provide communication between the first compartment and an external environment while the cover is coupled to the main body.

17. The enclosure for a luminaire of claim 15, further comprising a light engine disposed within the first compartment, a wire traverses an aperture in the wall and electrically connects the light emitter and the light engine.

18. The enclosure for a luminaire of claim 15, further comprising a grounding plate disposed within the main body and coupled to the light emitter.

19. The enclosure for a luminaire of claim 15, wherein the main body further includes an upper housing having a knockout configured to provide communication from an external environment to the first compartment.

* * * * *